United States Patent [19]

Kopelman

[11] 3,932,782

[45] Jan. 13, 1976

[54] HIGH PRESSURE SODIUM VAPOR LAMP HAVING IMPROVED MONOLITHIC ALUMINA ARC TUBE

[75] Inventor: Bernard Kopelman, Magnolia, Mass.

[73] Assignee: GTE Sylvania Incorporated, Danvers, Mass.

[22] Filed: Feb. 26, 1975

[21] Appl. No.: 553,356

Related U.S. Application Data

[63] Continuation of Ser. No. 352,970, April 20, 1973, abandoned.

[52] U.S. Cl. ..... 313/220; 313/221; 313/227

[51] Int. Cl.[2] ..... H01J 61/30; H01J 61/18

[58] Field of Search ..... 313/220, 221, 227, 229, 313/312, 317; 65/36; 264/57

[56] References Cited

UNITED STATES PATENTS

| | | | |
|---|---|---|---|
| 3,281,309 | 10/1966 | Ross | 161/196 |
| 3,363,134 | 1/1968 | Johnson | 313/220 |
| 3,564,328 | 2/1971 | Bagley et al. | 313/220 |
| 3,832,590 | 8/1974 | Yamazaki et al. | 313/220 X |

*Primary Examiner*—James W. Lawrence
*Assistant Examiner*—E. R. LaRoche
*Attorney, Agent, or Firm*—James Theodosopoulos

[57] ABSTRACT

A high pressure sodium vapor lamp contains a monolithic arc tube, the ends of which have a smaller inside diameter than has the body of the arc tube. Current-supply metal members are directly sealed in the ends of the arc tube.

3 Claims, 2 Drawing Figures

HIGH PRESSURE SODIUM VAPOR LAMP HAVING IMPROVED MONOLITHIC ALUMINA ARC TUBE

This is a continuation of application Ser. No. 352,970, filed Apr. 20, 1973, and now abandoned.

BACKGROUND OF THE INVENTION

1. Field Of The Invention

This invention relates to arc discharge lamps and, in particular, to high pressure sodium vapor lamps.

2. Description of the Prior Art

Within the past few years, high pressure sodium vapor lamps have become commercially useful, especially for outdoor lighting applications, because of their high efficiency, generally in excess of 100 lumens per watt. The sodium operating vapor pressure in such lamps is of the order of about 50–100 millimeters Hg.

Such lamps are called high pressure in order to distinguish them from low pressure sodium vapor lamps in which the sodium operating vapor pressure is in order of a few microns. Low pressure sodium lamps have been in use for about 30 or 40 years, but, although efficient, they produce an unattractive monochromatic yellow light. The color of light from high pressure sodium lamps is considerably improved over that from low pressure sodium lamps.

High pressure sodium lamps generally comprise an alumina ceramic arc tube and an arc tube fill of sodium, mercury, and an inert gas. Examples of such lamps are shown in the following U.S. Pat. Nos.: 3,248,590; 3,363,113; 3,384,798; 3,385,463; 3,428,846; 3,448,319; 3,453,477; 3,474,277; 3,485,343; 3,519,406; 3,520,039; 3,521,108; 3,558,963; 3,604,972; 3,609,437; 3,622,217; 3,650,593; 3,682,525; 3,708,710; 3,716,743; 3,716,744.

One of the problems of such lamps concerns the ceramic to metal seals at the ends of the alumina arc tube. Generally, a double seal is used. For example, a metal end cap is sealed to the end of a uniform diameter arc tube and a metal tube, usually niobium, is sealed to the metal end cap. Such seals are shown in U.S. Pat. Nos. 3,248,590; 3,384,798; 3,448,319; 3,479,170; 3,519,406; 3,588,577; 3,598,435; 3,450,927; 3,474,277; 3,480,823; 3,497,756; 3,682,525; 3,520,039; 3,385,463; 3,428,846; 3,604,972; 3,716,744; 3,721,845; and 3,721,846.

The metal end cap seal has been widely used commercially, but suffers from the very high cost of the metal end caps which are made of nobium metal. In addition, the high temperature glass-like frit which seals the metal end cap to the alumina tube is not capable of operating above about 800° C for thousands of hours and this places an upper limit on the temperature on the seal and within its vicinity.

Another type of end cap widely used, particularly in Europe, is a ceramic end plug disposed in the end of a ceramic arc tube while both the arc tube and end plug are in an unsintered state such that, upon high temperature sintering, the end plug forms a gas tight seal with the arc tube. A secondary end plug can be sealed to this configuration by a high temperature glass-like frit. This art is disclosed in U.S. Pat. Nos. 3,564,328 and 3,609,437. This type of seal is expensive because of the need of closely dimensioning the unsintered end plug to the unsintered arc tube such that on sintering they diffuse together. It is apparent that in both the metal cap construction and the ceramic cap construction, double seals are needed which are both expensive and lend themselves to potential difficulties because of the added processing.

It is an object of this invention to eliminate such double seals and to reduce the ceramic-to-metal seal area in order to provide a more reliable longer-life arc tube.

SUMMARY OF THE INVENTION

A high pressure sodium lamp in accordance with this invention comprises a polycrystalline alumina arc tube containing a fill of sodium, mercury and inert gas and having electrodes at each end. The arc tube is of monolithic construction and has ends which have a smaller inside diameter than that of the body of the arc tube. This is accomplished by the use of internal mandrels, during manufacture of the arc tubes, which have fairly low melting points and can thus be removed from the inside of the pressed tube by melting. Current-carrying and electrode-supporting metal members are sealed in and extend beyond the ends of the arc tube.

DESCRIPTION OF THE PREFERRED EMBODIMENT

Figure 2:
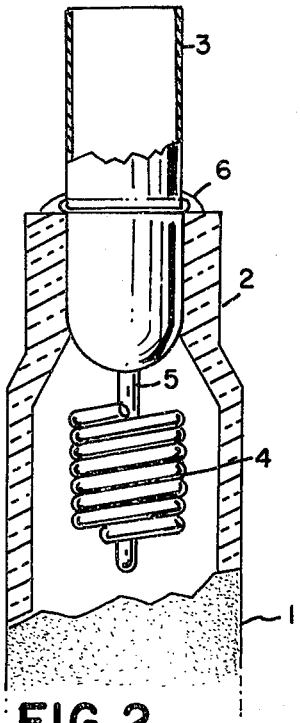
FIG. 2 is an expanded view, partly in section, of the end portion of the arc tube of FIG. 1.
Figure 1:
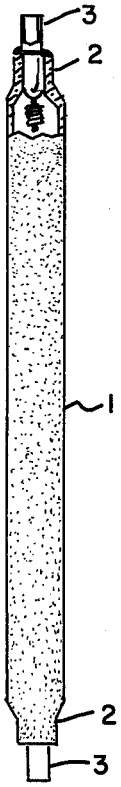
FIG. 1 is an elevational view, partly in section, of an arc tube of a high pressure sodium lamp in accordance with this invention.

Arc tube 1 has a generally tubular shape with a substantially uniform inside diameter throughout most of its length except at its ends 2, which have a smaller inside diameter. Arc tube 1 is made from high purity alumina powder which contains small amounts of grain growth inhibiting materials and is of monolithic construction. That is to say, before firing, arc tube 1 is pressed into a reduced end diameter shape, instead of being pressed into a uniform cylinder, as in the prior art.

Sealed in ends 2 of arc tube 1 are metal members 3. Metal members 3 are supports and lead-in conductors for electrodes 4 which are disposed within arc tube 1. Members 3 have a diameter close to the inside diameter of ends 2 in order to be a slip fit therein and to permit provision of a reliable seal therebetween. Seals between members 3 and ends 2 are formed by known sealant materials.

Prior to sealing of member 3 in end 2, the usual lamp fill, such as mercury, sodium and inert gas, is placed in arc tube 1. The lamp is completed in the usual manner by disposing arc tube 1 within an outer glass envelope (not shown) and by electrically connecting members 3 to the usual screw-type base at one end of said envelope.

In a 400 watt high pressure sodium lamp in accordance with this invention, arc tube 1 was 4.4 inches long and had inner and outer diameters along its length between ends 2 of 0.288 and 0.350 inches, respectively. Ends 2 of arc tube 1 extended longitudinally about 0.2 inches and had inner and outer diameters of 0.162 and 0.300 inches, respectively.

Each metal member 3 was a thin wall niobium tube having an outer diameter of 0.160 inches. The inner end of member 3 was sealed and had a 41 mil tungsten rod 5 welded thereto, protruding axially into arc tube 1. Supported on the inner end of rod 5 was the usual electrode 4.

In the manufacture of arc tube 1, a thick-wall cylindrical tube made of a hard rubbery material, such as polyurethane, is used as a mold for the alumina powder to be isostatically pressed. Axially positioned within the mold is a pattern the shape of which corresponds to the inside shape of arc tube 1 but somewhat enlarged to compensate for shrinkage of the pressed arc tube during processing. The pattern for the arc tube described above was a low melting alloy (such as Cerrobend) with a diameter of 0.387 inches except at the ends where it tapers to 0.225 inches; it is 7 inches long. The Cerrobend alloy consists of 50% bismuth, 26.7 % lead, 13.3% tin, and 10% cadmium and has a melting point of 150° F.

The pattern was axially positioned within the rubbery mold, which had an I.D. of 0.585 inches, and the space between the pattern and mold was filled with alumina powder. The mold was isostatically pressed at 12,500 psi and the pressed alumina tube was then removed from the mold. In order to remove the pattern from within the pressed alumina tube, heat is applied thereto until the Cerrobend material melts and flows out of the alumina tube. Next, the pressed tube is fired, first at a temperature of about 1000°–1200°C and, subsequently, at a higher temperature, 1600°–1800°C, to achieve maximum densification and strength. The firing also eliminates any shell material impurity in the alumina.

There are other ways of accomplishing the internal shaping of the arc tube in addition to the use of a low melting alloy: hard waxes may be used or plastics which can be melted. In addition, the pattern can be made of a perforated metal tube whose diameter is equal to the diameter of the arc tube ends. The perforated tube is filled internally with the low melting material and externally shaped to the internal configuration of the arc tube. After isostatically pressing the alumina powder onto this pattern within the rubber mold, this pattern can be removed by heating in which the low melting material runs out through the perforated tube on melting and the tube will then readily slide out. To date, the Cerrobend alloy has been found easiest to use, but the wax pattern is potentially slightly less expensive.

In this example, seal 6 between niobium tube 3 and end 2 of arc tube 1 was generally peripheral around niobium tube 3, which had a diameter of 0.160 inches. Without the reduced diameter end of this invention, a seal in accordance with the prior art would have included a larger periphery, at least 0.288 inches diameter for a 400 watt lamp. This is a reduction of about 45% in the length of the seal line.

For minimum seal area, the hole through end 2 should be as small as possible. However, said hole must be large enough to permit electrode 4 to be inserted therethrough. In this example the diameter of electrode 4 was 0.160 inches.

I claim:

1. A high pressure sodium vapor lamp comprising a monolithic polycrystalline alumina arc tube having electrodes disposed at the ends thereof and containing a fill including sodium, mercury and inert gas, said arc tube consisting of a tubular body portion and two end portions, the outside diameter of said end portions being smaller than the outside diameter of said body portion, there being no sealing region between said end portion and said body portion, said body portion having a uniform inside diameter throughout its length, each of said end portions having an axial hole therethrough, the diameter of said axial hole being smaller than the inside diameter of the body portion, cylindrical metallic members extending through and sealed to said end portions, said electrodes being supported on metal rods extending from the internal ends of said metallic members.

2. The lamp of claim 1 wherein said metallic member is a niobium tube sealed at its internal end.

3. The lamp of claim 1 wherein the diameter of said axial hole exceeds only slightly the diameter of said electrode.

* * * * *